US009558666B2

(12) United States Patent
Jansson et al.

(10) Patent No.: US 9,558,666 B2
(45) Date of Patent: Jan. 31, 2017

(54) COLLISION AVOIDANCE IN TRAFFIC CROSSINGS USING RADAR SENSORS

(71) Applicant: Robert Bosch GmbH, Stuttgart (DE)

(72) Inventors: Christer Jansson, Commerce Twp., MI (US); Shuvo Bhattacharjee, Tecumseh (CA); Hirak Chanda, Troy, MI (US); Ankit Shah, Canton, MI (US); Troy McCormick, Milford, MI (US); Ali Fawaz, Tecumseh (CA); Anthony Farrell, Clinton, MI (US)

(73) Assignee: Robert Bosch GmbH, Stuttgart (DE)

( * ) Notice: Subject to any disclaimer, the term of this patent is extended or adjusted under 35 U.S.C. 154(b) by 79 days.

(21) Appl. No.: 14/558,348

(22) Filed: Dec. 2, 2014

(65) Prior Publication Data

US 2016/0155334 A1 Jun. 2, 2016

(51) Int. Cl.

| | |
|---|---|
| ***G08G 1/07*** | (2006.01) |
| ***G08G 1/01*** | (2006.01) |
| ***G08G 1/16*** | (2006.01) |
| ***G08G 1/08*** | (2006.01) |
| *G08G 1/083* | (2006.01) |

(52) U.S. Cl.

CPC ..... *G08G 1/164* (2013.01); *G08G 1/07* (2013.01); *G08G 1/08* (2013.01); *G08G 1/083* (2013.01)

(58) Field of Classification Search

CPC ..... G08G 1/005; G08G 1/07; G08G 1/08; G01S 13/92

USPC ..... 340/906, 923, 925, 917, 933; 701/117, 701/301

See application file for complete search history.

(56) References Cited

U.S. PATENT DOCUMENTS

| | | | | |
|---|---|---|---|---|
| 6,281,808 | B1 * | 8/2001 | Glier | G07B 15/06 340/916 |
| 6,317,058 | B1 | 11/2001 | Lemelson et al. | |
| 2005/0046597 | A1 * | 3/2005 | Hutchison | G08G 1/07 340/917 |
| 2005/0110660 | A1 | 5/2005 | Jacobs | |
| 2005/0138488 | A1 * | 6/2005 | Jacobs | G08G 1/097 714/56 |
| 2006/0142933 | A1 * | 6/2006 | Feng | G07B 15/063 701/117 |
| 2006/0181433 | A1 * | 8/2006 | Wolterman | G08G 1/164 340/917 |
| 2009/0146841 | A1 * | 6/2009 | Basson | G08G 1/07 340/925 |

(Continued)

FOREIGN PATENT DOCUMENTS

| | | |
|---|---|---|
| CA | 2232739 | 11/1999 |
| WO | 2009/150528 | 12/2009 |

OTHER PUBLICATIONS

Extended European Search Report for Application No. 15193364.5 dated Apr. 26, 2016 (7 pages).

*Primary Examiner* — George Bugg
*Assistant Examiner* — Munear Akki
(74) *Attorney, Agent, or Firm* — Michael Best & Friedrich LLP

(57) ABSTRACT

A system and method for avoiding collisions in a traffic intersection using radar sensors is disclosed. The system detects the location, speed, size, and direction of travel of objects, including vehicles and vulnerable road users, in and approaching a traffic intersection. Using this information, trajectories for all objects are determined, and, if a likelihood of a collision is determined, one or more traffic signal transitions are delayed in an attempt to avoid the collision.

9 Claims, 8 Drawing Sheets

(56) References Cited

U.S. PATENT DOCUMENTS

| | | | | |
|---|---|---|---|---|
| 2011/0298603 | A1 | 12/2011 | King et al. | |
| 2012/0089321 | A1 | 4/2012 | Jung | |
| 2012/0130629 | A1 | 5/2012 | Kim | |
| 2012/0188098 | A1 | 7/2012 | Mochizuki | |
| 2013/0194108 | A1 | 8/2013 | Lapiotis et al. | |
| 2013/0253816 | A1 | 9/2013 | Caminiti et al. | |
| 2013/0285840 | A1* | 10/2013 | Allen | G08G 1/07 340/923 |
| 2015/0154860 | A1* | 6/2015 | Holzwanger | G08G 1/005 340/944 |

* cited by examiner

COLLISION AVOIDANCE IN TRAFFIC CROSSINGS USING RADAR SENSORS

BACKGROUND

The present invention relates collision avoidance. More particularly, embodiments of the invention relate to radar-based systems designed to predict and avoid collisions at traffic intersections.

SUMMARY

In one embodiment, the invention provides a system for avoiding collisions in a multi-sided traffic intersection. The system includes one or more radar sensors positioned to detect objects approaching the traffic intersection from all of the sides, a traffic-lights-and-turn-signals controller for controlling the traffic signals at the intersection, and an ambient conditions sensor. The ambient conditions sensor is capable of sensing at least an ambient temperature value and a relative humidity value for the air proximate the traffic intersection. The system also includes a central controller, which is electrically connected to the radar sensors, the traffic-lights-and-turn-signals controller, and the ambient conditions sensor. The system's central controller receives data from the radar sensors, the ambient conditions sensor, and the traffic-lights-and-turn-signals controller. The controller uses that data to predict the likelihood of a collision occurring during a traffic signal transition. If the controller determines that a collision is likely, then it issues a command to the traffic-lights-and-turn-signals controller to cause a delay in the traffic signal transition, while maintaining a predetermined traffic signal timing sequence for the intersection.

Another embodiment of the invention provides a system for avoiding collisions in a multi-sided traffic intersection that includes pedestrian crosswalks. In this embodiment, the radar sensors are positioned to detect objects approaching the traffic intersection from all of the sides, and to detect objects in the pedestrian crosswalks. This embodiment further includes a pedestrian-signals controller, which also provides data to the system's central controller. The controller uses that data, along with data from the radar sensors, the ambient conditions sensor, and the traffic-lights-and-turn-signals controller, to predict the likelihood of a collision occurring during a traffic signal transition. If the controller determines that a collision is likely, then it issues a command to the traffic-lights-and-turn-signals controller to cause a delay in the traffic signal transition, while maintaining a predetermined traffic signal timing sequence for the intersection.

In some embodiments of the invention, a traffic signal transition occurs when the traffic signal for incoming traffic changes from green to amber to red, and the traffic signal for stopped traffic changes from red to green. Delaying this traffic signal transition includes delaying the changing of the traffic signal for stopped traffic from red to green.

In other embodiments of the invention, a traffic signal transition occurs when the a turn arrow for incoming traffic changes from green to amber to red, and the traffic signal for stopped traffic changes from red to green. Delaying this traffic signal transition includes delaying the changing of the traffic signal for stopped traffic from red to green.

In embodiments of the system including a pedestrian-signals controller, delaying the traffic signal transition may also include delaying a crosswalk signal changing from don't walk to walk.

In some embodiments, the central controller can communicate the likelihood of a collision to an intelligent traffic system.

Some embodiments of the system include a watchdog mechanism, which monitors the operation of the system for the existence and source of a malfunction. These embodiments of the system also include a failsafe mechanism for instructing the central controller to avoid relying on the source of the malfunction. When the watchdog mechanism detects a malfunction, it activates the failsafe mechanism.

In another embodiment, the invention provides a method for operating traffic signals for collision avoidance. The method includes detecting at least one object in or approaching a traffic intersection. Each object detected is a vehicle or a vulnerable road user. For each object detected, a location, a direction of travel, a speed, and a size are received. A temperature value and a relative humidity value for the air near the traffic intersection are also received and a coefficient of friction for the intersection is estimated. The trajectory of each detected object is determined. The remaining time for a traffic signal transition is received. Then, the likelihood of a collision is determined using the trajectories for all detected objects, the coefficient of friction of the intersection, and the remaining time for the traffic signal transition. Finally, to avoid the collision, the traffic signal transition is delayed. To prevent disruption of traffic flow, a predetermined traffic signal timing sequence is maintained despite the delay.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
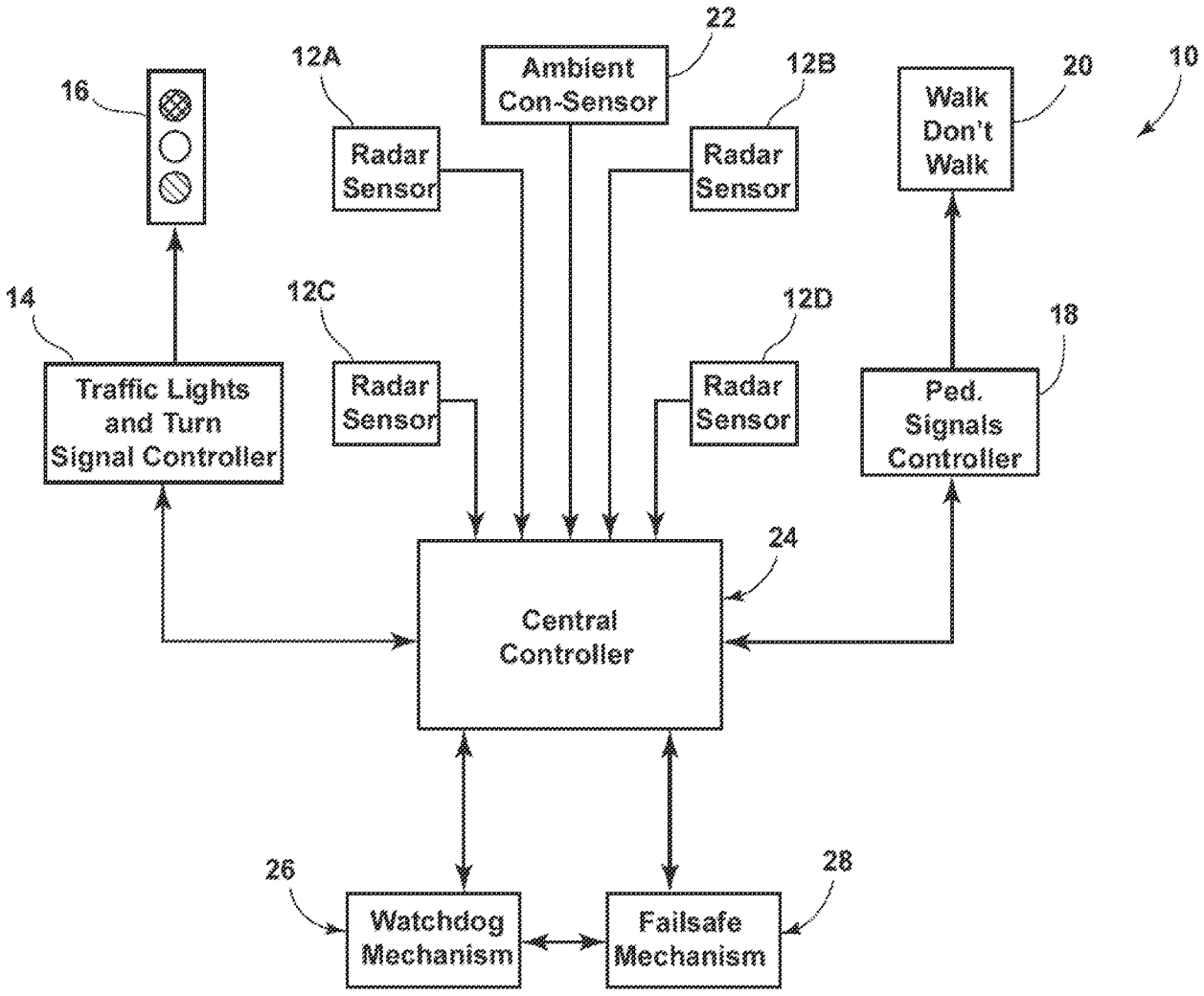
FIG. 1 illustrates one possible embodiment of the collision avoidance system.

FIG. 1 illustrates one possible embodiment of a collision avoidance system 10, configured for use with a four-sided traffic intersection that includes pedestrian crosswalks. In this embodiment, the system has four radar sensors 12A-D, each positioned to detect objects approaching, or present in, a different side of a traffic intersection. The radar sensors 12A-D sense and communicate data on the position and velocity of objects in and proximate the traffic intersection in which they are deployed. In embodiments where the system is configured for use with intersections having more or less than four sides, a different number of radar sensors may be used to detect vehicles approaching the intersection. Some embodiments may use more or less than one radar sensor per intersection side. The system also includes a traffic-lights-and-turn-signals controller 14, which controls the timing of at least one traffic signal 16. Traffic signal 16 could be any traffic signaling device, including a red, yellow, and green light signal, a turn lane signal, or other traffic signal. The system also includes a pedestrian-signals controller 18, which controls the timing of a crosswalk signal 20. Other embodiments of the system 10 do not include a pedestrian-signals controller when, for example, the system is deployed in intersections lacking pedestrian crosswalks. The system 10 may also include an ambient conditions sensor 22, which is located such that it is able to sense conditions of the environment proximate a traffic intersection in which the system is deployed. In this embodiment, the ambient conditions sensor 22 senses and communicates data on the ambient temperature and relative humidity of the air proximate the intersection. In other embodiments, the ambient conditions sensor 22 may sense other ambient conditions that are useful in predicting the likelihood of a collision. For example, light levels might be sensed to account for driver or pedestrian visibility when making stopping distance or other calculations.

In the embodiment illustrated, the system 10 also includes a central controller 24, which is electrically connected to the radar sensors 12A-D, the traffic-lights-and-turn-signals controller 14, the pedestrian-signals controller 18, and the ambient conditions sensor 22. This electrical connection can be a wired or wireless connection, made in such a fashion as to allow transmission of electrical or data signals between the devices, including fiber optic, radio frequency, and other means. The central controller receives data from the radar sensors 12A-D, the traffic-lights-and-turn-signals controller 14, the pedestrian-signals controller 18, and the ambient conditions sensor 22. The central controller 24 uses that data to predict the likelihood of collisions between the objects detected by radar sensors 12A-D. Some possible processes that the controller uses to predict the likelihood of a collision are set forth below and illustrated in FIGS. 5, 5A, 6, and 6A.

For some types of predicted collisions, it is possible that the collision can be avoided by delaying the transition of traffic signals in the intersection. For example, in some cases, the transition of the traffic signal 16 from red to green could be delayed in an attempt to prevent vehicles from entering the intersection while other vehicles are still clearing the intersection, or approaching the intersection at a moderate-to-high rate of speed. In other cases, the crosswalk signal 20 transition from "Don't Walk" to "Walk" could be delayed to prevent a pedestrian from entering the crosswalk while vehicles are still clearing the intersection, or approaching the intersection at a moderate-to-high rate of speed. Of course, rather than the words "Don't Walk" and "Walk" universal symbols could be displayed, light, or otherwise actuated to inform a pedestrian when to cross the crosswalk and when to stay out of it. When the central controller 24 predicts that one or more of these avoidable collisions is likely, it issues commands to the traffic-lights-and-turn-signals controller 14 and the pedestrian-signals controller 18 to delay one or more traffic signal transitions in an attempt to avoid the collision.

In a traffic intersection where traffic flow is controlled by traffic signals, traffic signal transitions occur in a predetermined traffic signal timing sequence. The following is an example of a timing sequence at a four-way, North-South/East West traffic intersection: The North-South signals signal green for 19 seconds, then yellow for 4 seconds, and then red for 23 seconds. For the 23 seconds that the North-South signals are signaling green or yellow, the East-West signals are signaling red. During the 23 seconds that the North-South signals are signaling red, the East-West signals signal green for 19 seconds, then yellow for 4 seconds. This timing sequence repeats to allow traffic to flow through the intersection. Another timing sequence might include a longer green light, and a correspondingly longer red light, to allow more traffic to flow in one direction than another. This is typical when one road is larger than the other. Traffic engineers determine what sequence works best at a given traffic intersection. Multiple sequences might be used for one intersection. A traffic signal timing sequence is chosen using factors that affect traffic flow, such as the time of day. Managing traffic flow through an intersection depends on, among other things, maintaining the determined traffic signal timing sequence for the traffic intersection.

Embodiments of the invention maintain the determined traffic signal timing sequence for the traffic intersection in which the system is deployed. In order to maintain the determined traffic light timing sequence, when the central controller 24 delays a traffic signal transition, it will subtract the delay time from the signal transition, rather than extending it. For example, if the central controller 24 delays the transition of traffic signal 16 from red to green for two seconds to allow vehicles to clear the intersection, traffic signal 16 will be green for two seconds less than it would have been without the delay. The transition of traffic signal 16 from green to amber will begin at the same time that it was scheduled to begin, regardless of the delay, thereby maintaining the determined traffic light timing sequence.

Intelligent traffic systems improve transportation safety and traffic flow through an interconnected traffic infrastructure, and the integration of communications technologies into the transportation infrastructure and vehicles. The integration of communications technologies allows for various V2X communications techniques, including vehicle-to-infrastructure communication (V2I), and vehicle-to-vehicle communication (V2V).

In other embodiments, the central controller 24 can use V2X or other communication techniques that enable a vehicle to communicate with its surroundings, to signal vehicles proximate the intersection that the central controller 24 has predicted the likelihood of a collision.

In some intelligent traffic systems, a single traffic intersection is sometimes part of a larger group of traffic intersections, which are controlled as a group to achieve a desired traffic flow, or for other purposes. This group control is achieved through an overall traffic signaling pattern for the group. As part of its function, the collision avoidance system 10 delays traffic signal transitions at individual intersections. In order to avoid disrupting of the overall traffic signaling pattern, in some embodiments, the central controller 24 maintains the determined traffic signal timing sequence for the traffic intersection in which the system is deployed, as noted above. In this way, the system avoids propagating a delay in traffic caused by a shift in the traffic signal timing sequence throughout the group of intersections, thereby maintaining the determined traffic signal timing sequence of the larger group of intersections.

In some embodiments, the collision avoidance system 10 includes a watchdog mechanism 26, which can be separate from, or integral to, the central controller 24. The watchdog mechanism can be implemented in software, hardware, or a combination of both. The watchdog mechanism monitors the components of the system, including the sensors, controllers, and signals, to ensure they are functioning properly. If the watchdog detects a malfunction in a component, it will implement an appropriate failsafe mechanism 28. The failsafe mechanism can be implemented in software, hardware, or a combination of both. For example, if one radar sensor detects the presence of a vehicle that the watchdog knows should also be detected by another radar sensor that does not report it, the watchdog might determine that one or both of the sensors is malfunctioning. The watchdog could then implement a failsafe to bypass the system functions that rely on accurate readings from those sensors. In another example, a component could stop communicating with the central controller 24 altogether, triggering a failsafe that avoids any actions relying on the affected component.

Figure 2:
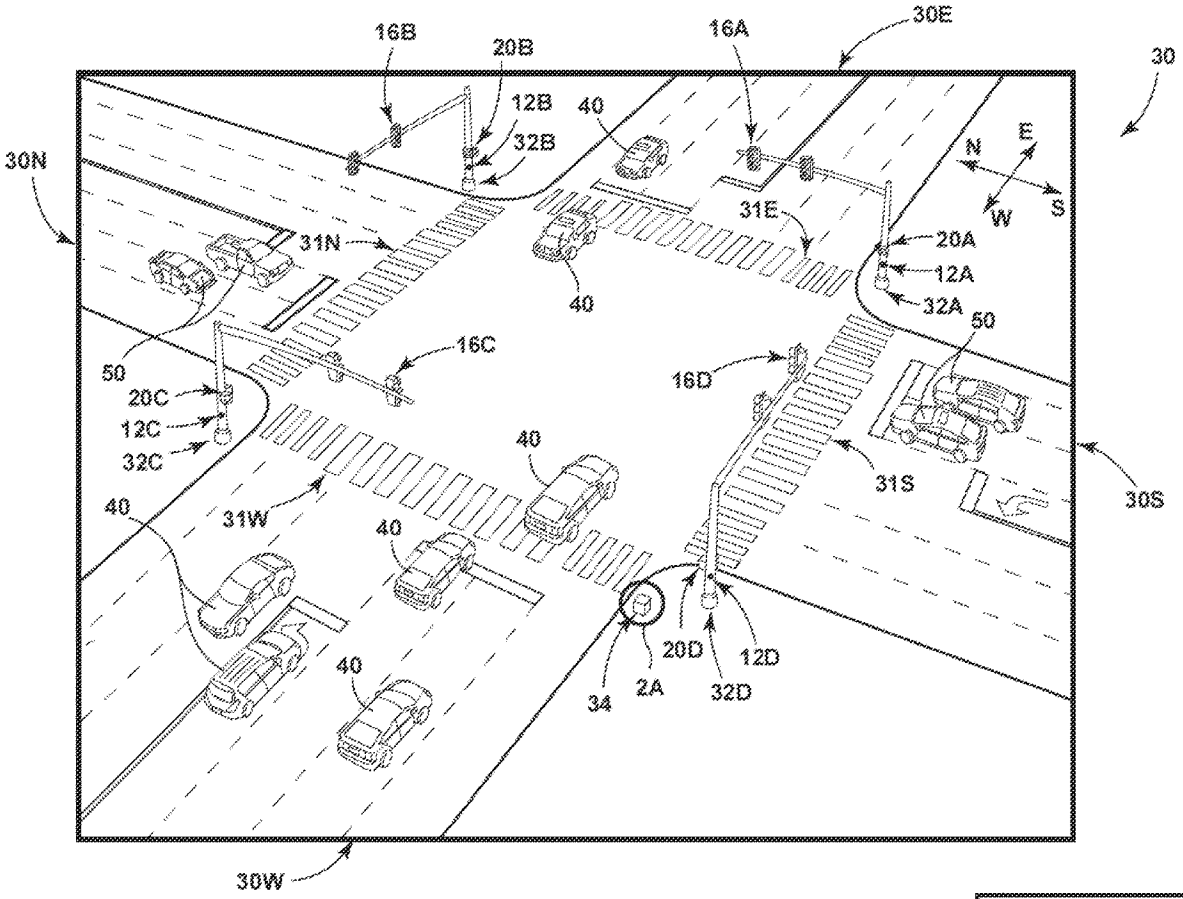
FIG. 2 illustrates an embodiment of the invention illustrated in FIG. 1 implemented in the form of a system installed at a four-sided traffic intersection and designed to reduce the probability of collisions involving vehicles traveling in opposite directions through the traffic intersection.
Figure 2A:
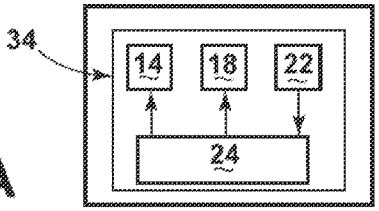
FIG. 2A illustrates a cabinet used in some embodiments of the invention.

FIG. 2 illustrates the collision avoidance system 10 installed in a traffic intersection 30. The traffic intersection 30 has four sides 30N, 30S, 30E, 30W. The intersection also has four pedestrian crosswalks, 31N, 31S, 31E, 31W. Although a four-sided intersection is illustrated, in other embodiments, the system 10 may be configured for use with intersections having another number of sides. Traffic intersection 30 includes four traffic poles 32A, 32B, 32C, 32D, on which are mounted radar sensors 12A, 12B, 12C, 12D, four traffic signals 16A, 16B, 16C, 16D, and four crosswalk signals 20A, 20B, 20C, 20D. The traffic signals are controlled by the traffic-lights-and-turn-signals controller 14, and the crosswalk signal is controlled by the pedestrian-signals controller 18. The traffic-lights-and-turn-signals controller 14, the pedestrian-signals controller 18, the ambient conditions sensor 22, and the central controller 24 are located in cabinet 34. FIG. 2A illustrates cabinet 34 in more detail. In other embodiments of the system, traffic-lights-and-turn-signals controller 14, the pedestrian-signals controller 18, the ambient conditions sensor 22, and the central controller 24 could be located separate from each other, or in other locations, such as boxes on or in the traffic poles, underground, or using other methods known in the art.

As explained above in relation to FIG. 1, radar sensors 12A-D detect objects in and proximate traffic intersection in which they are deployed, and communicate data on the position and velocity of the detected objects. Objects that can be detected by the radar sensors 12A-D include at least vehicles and vulnerable road users. Vehicles include at least automobiles and trucks. Vulnerable road users include at least pedestrians, bicyclists, mopeds, or other objects in or near the intersection that are smaller or slower moving than vehicles.

In the embodiment illustrated in FIG. 2, the radar sensors 12A-D are positioned or otherwise oriented to facilitate detection of the position and speed of incoming vehicles 40 and opposing incoming vehicles 50 approaching the traffic intersection 30 from all four sides 30N, 30S, 30E, and 30W.

In the operation of the embodiment illustrated in FIG. 2, the radar sensors 12A-D collect data on the speed and location of incoming vehicles 40 and opposing incoming vehicles 50. The radar sensors 12A-D transmit this data to the central controller 24, which uses the data, along with data collected from the traffic-lights-and-turn-signals controller 14, the pedestrian-signals controller 18, and the ambient conditions sensor 22, to predict the likelihood of a collision, which could be avoided through the delay of a traffic signal transition.

The following are examples of traffic signal transitions, in the embodiment of the invention illustrated in FIG. 2, which occur when one of traffic signals 16A-D: changes from green to amber to red, to signal incoming vehicles to stop; changes from red to green, to signal stopped vehicles that they may begin moving through the intersection; or changes from green turn arrow to amber turn arrow to red turn arrow, to signal vehicles that they may no longer proceed in a left turn through the intersection. Traffic signal transitions also occur when one or more of the crosswalk signals 20A-D: change from "Walk" to "Don't Walk" to signal pedestrians not to enter the crosswalk, or change from "Don't Walk" to "Walk" to signal pedestrians that they may enter the crosswalk to begin crossing the street. Multiple traffic signal transitions may occur simultaneously, or in varied sequence, depending on how traffic is controlled at a given intersection.

In prior-art systems, during a traffic signal transition, traffic signals 16A, 16C would transition from green to amber to red, and traffic signals 16B, 16D would transition from red to green, signaling the opposing incoming vehicles 50 to proceed through the intersection—without regard to the location or speed of incoming vehicles 40. If any of the incoming vehicles 40 have not stopped prior to entering the traffic intersection 30, a collision could occur, possibly causing property damage, injury, and loss of life.

In FIG. 2, Radar sensors 12A-D sense the speed and locations of incoming vehicles 40 and opposing incoming vehicles 50 as they approach the intersection 30, or wait to enter. Incoming vehicles 40 are signaled by traffic signals 16A and 16C. Opposing incoming vehicles are signaled by traffic signals 16B and 16D. If the central controller 24 determines that a collision is likely, it will delay the traffic signal transitions in an attempt to avoid the collision. For example, if, during the transition of traffic signals 16A and 16C from amber to red, any of the incoming vehicles 40 are not slowing down, but speeding up, and, at the same time, the opposing incoming vehicles 50 are coming at moderate speed, the central controller 24 may predict that a collision is likely based on the location and speed of the vehicles sensed by radar sensors 12A-D. If the central controller 24 predicts that a collision is likely, it will issue commands to the traffic-lights-and-turn-signals controller 14, which will delay the red to green transition of traffic signals 16B, 16D sufficient to delay entry into the intersection of opposing incoming vehicles 50, and allow time for the incoming vehicles 40 to safely clear the intersection. In an attempt to avoid a collision with pedestrians entering pedestrian crosswalk 31E, the central controller 24 will also issue commands to the pedestrian-signals controller 18, to delay the transition of crosswalk signals 20A, 20B from "Don't Walk" to "Walk."

Figure 3:
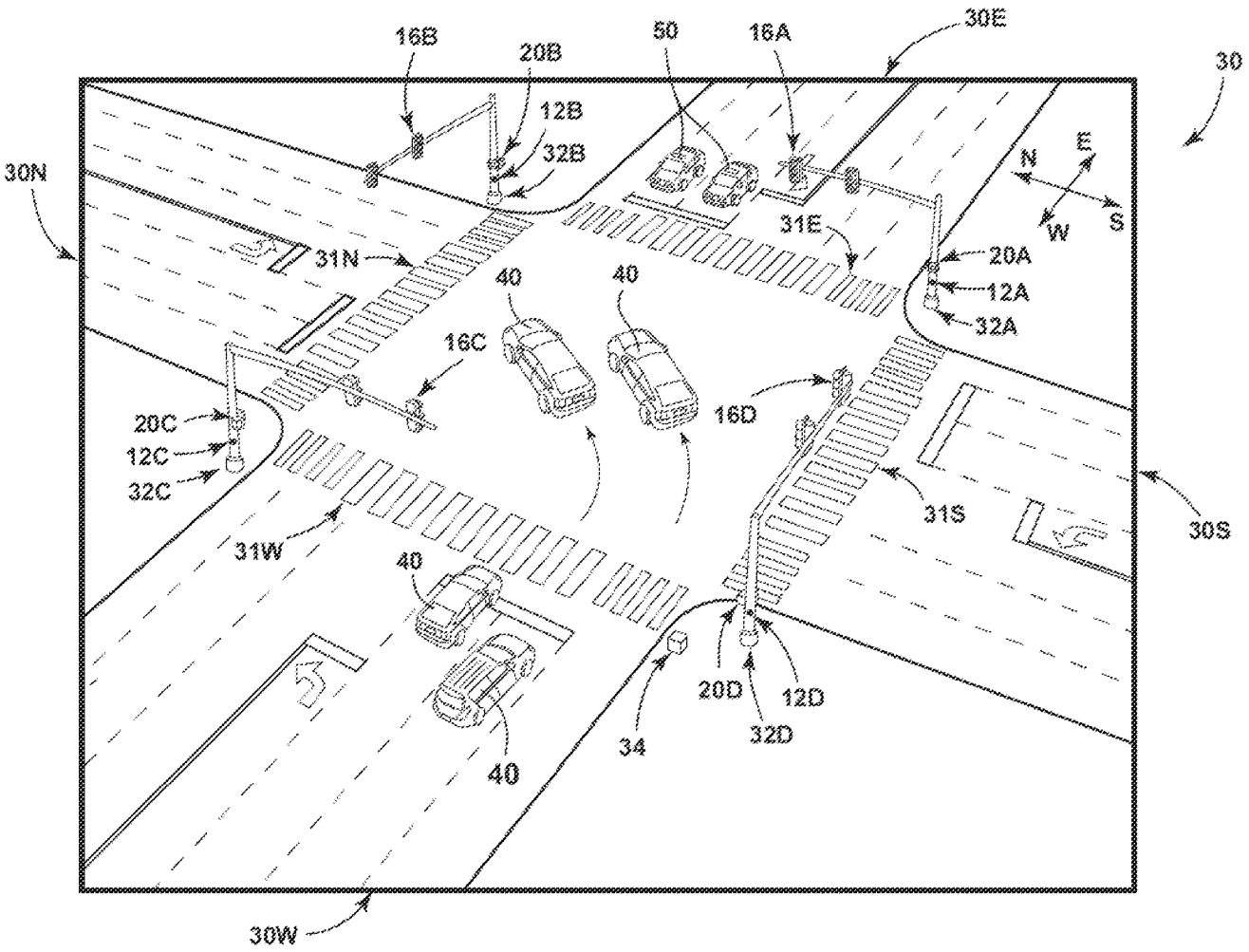
FIG. 3 illustrates another embodiment of the invention configured to reduce collisions involving vehicles turning left in a traffic intersection having four sides

Another possible embodiment is shown in FIG. 3. In this embodiment, radar sensors 12A-D can sense the speed and locations of incoming vehicles 40 as they turn left through the intersection, and opposing incoming vehicles 50 as they approach the intersection or are stopped waiting to enter the intersection. Incoming vehicles 40 are signaled by traffic signal 16A. Opposing incoming vehicles 50 are signaled by traffic signal 16C. If, during the transition of traffic signal 16A from green turn arrow to yellow turn arrow to red turn arrow, the incoming vehicles 40 are still proceeding into or through the intersection to make a left turn, and, at the same time, the opposing incoming vehicles 50 are either stopped waiting to enter the intersection or coming at moderate speed, then the central controller 24 can predict that a collision is likely based on the location and speed of the vehicles sensed by radar sensors 12A-D. If the central controller 24 predicts that a collision is likely, it will issue commands to the traffic-lights-and-turn-signals controller 14, which will delay the red to green transition of traffic signal 16C sufficient to delay entry into the intersection of opposing incoming vehicles 50, and allow time for the incoming vehicles 40 to safely clear the intersection. In an attempt to avoid a potential collision with pedestrians entering pedestrian crosswalk 31N, the central controller 24 will also issue commands to the pedestrian-signals controller 18, to delay the transition of crosswalk signals 20B, 20C from "Don't Walk" to "Walk."

Figure 4:
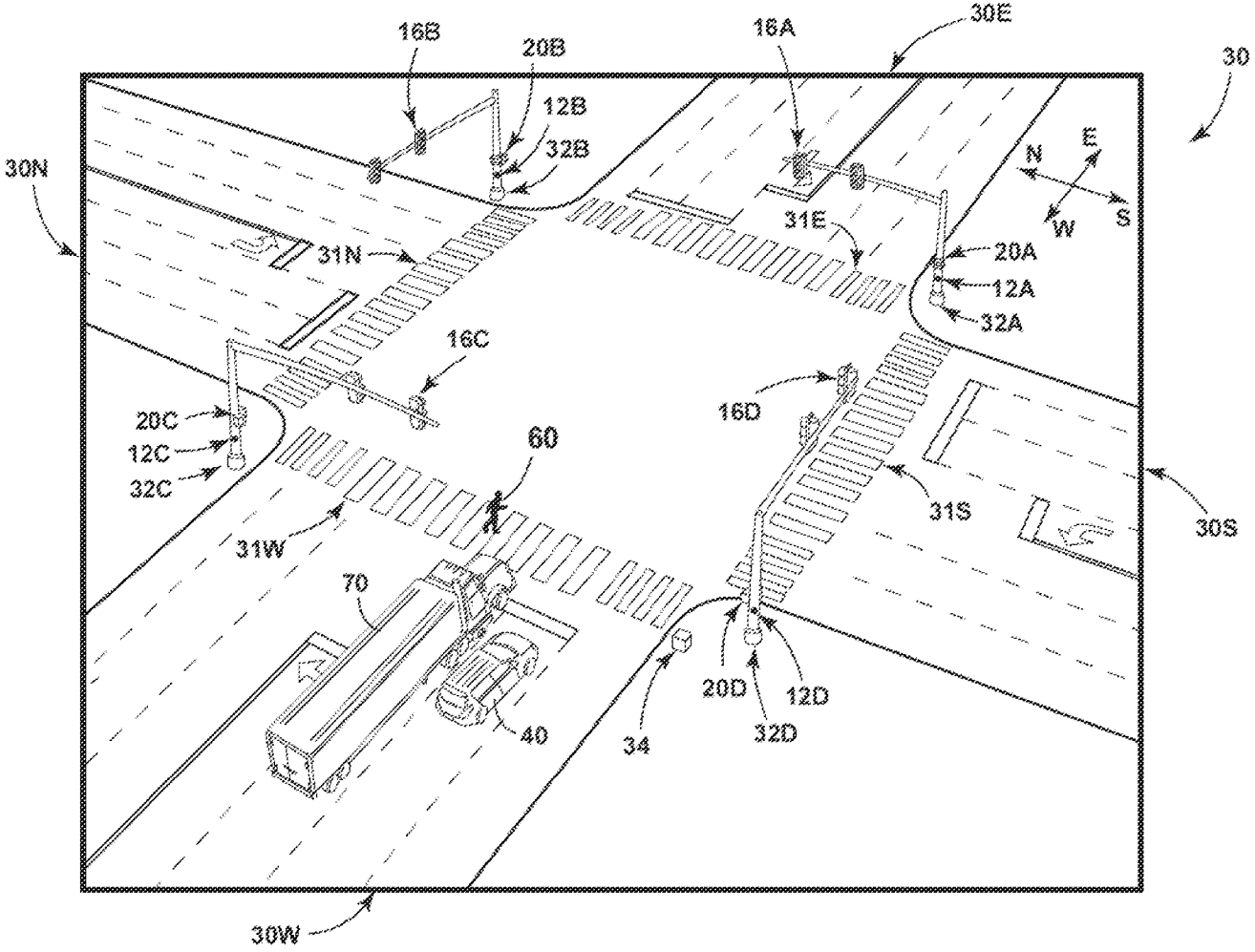
FIG. 4 illustrates another embodiment of the invention configured to warn against vehicle-to-pedestrian collisions.

Another possible embodiment is shown in FIG. 4, which illustrates how the system 10 can be used to warn against predicted vehicle-to-pedestrian collisions. In this embodiment, a pedestrian 60 is crossing the intersection 30 in pedestrian crosswalk 31W. Traffic signal 16A is red, and crosswalk signal 20D displays "Walk." Pedestrian 60 cannot see incoming vehicle 40, which is approaching the intersection to make a right turn, because his vision is blocked by large vehicle 70. If incoming vehicle 40 fails to stop before turning, a collision could occur between pedestrian 60 and incoming vehicle 40. If central controller 24 predicts that such a collision is likely, it may issue a warning using V2X or other communications techniques. In other embodiments, the central controller issues warnings if the data from radar sensors 12A-D indicates the presence of other vulnerable road users in positions such that a collision is likely. In other embodiments, the presence of vulnerable road users in the traffic lanes could be used to delay signal transitions where doing so could avoid a collision.

FIGS. 5, 5A, 6, and 6A, illustrate, according to some embodiments of the system 10, processes that the central controller 24 uses to determine the likelihood of a collision. The processes use the data provided by the radar sensors, which are represented by the following variables: X1($t$) and X2($t$) are the locations of vehicles moving East and West, respectively; Y1($t$) and Y2($t$) are the locations of vehicles moving North and South, respectively; and Vx1($t$),Vx2($t$), Vy1($t$),Vy2($t$) are the velocities of the vehicles in the respective directions. Using data from the radar sensors, the central controller 24 determines, ax1($t$), ax2($t$), ay1($t$) and ay2($t$), which represent the acceleration of the vehicles in the respective directions. A negative value of acceleration indicates deceleration. The ambient conditions sensor 22 provides the central controller 24 with an ambient temperature value (T), which is the air temperature proximate the traffic intersection 30, and a relative humidity value (rH), which is the relative humidity of the air proximate the traffic intersection 30. The central controller 24 uses T and rH to estimate the coefficient of friction (μ) of the road surface.

Figure 5:
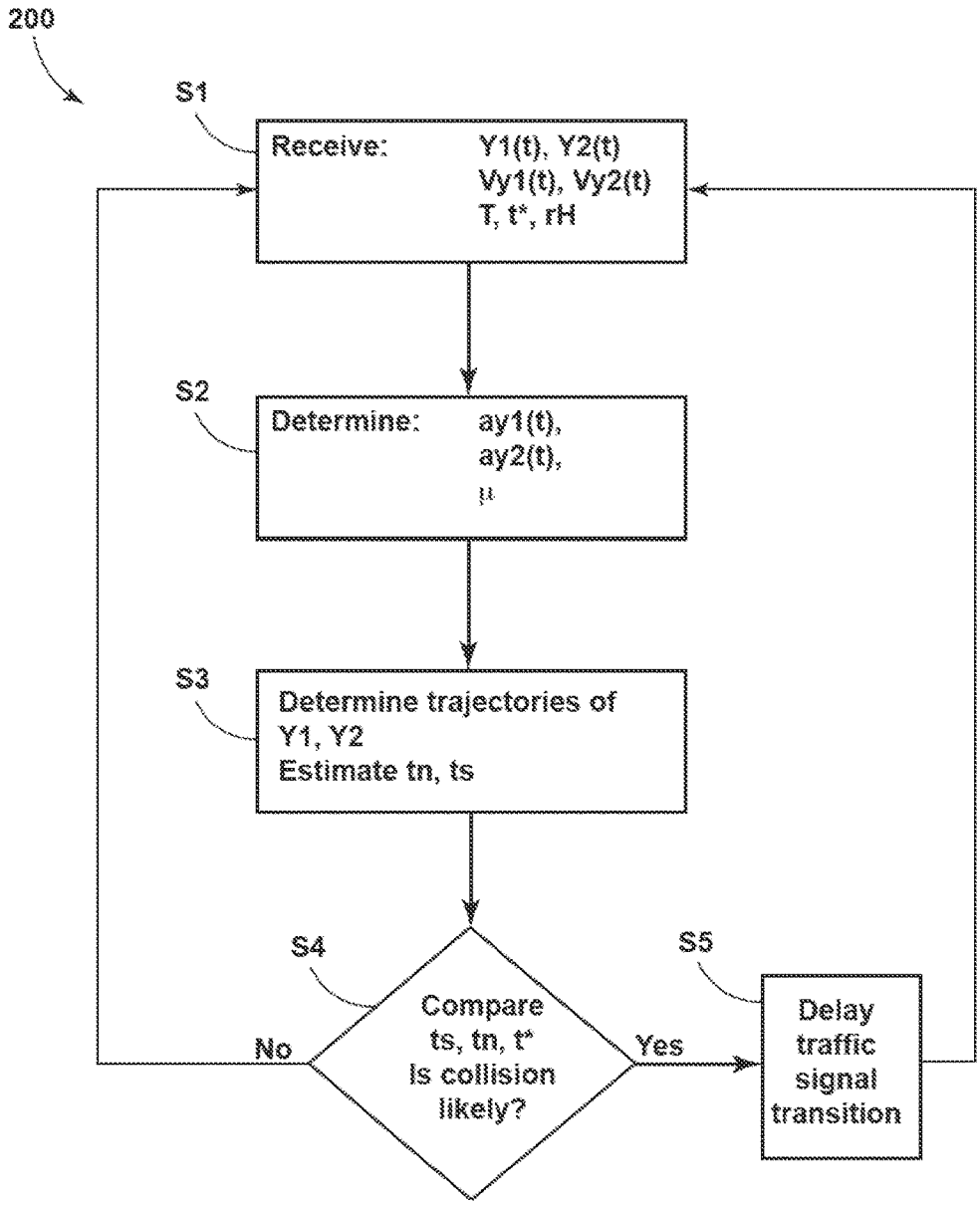
FIG. 5 illustrates one possible process for detecting the likelihood of a collision involving a left turn.
Figure 5A:
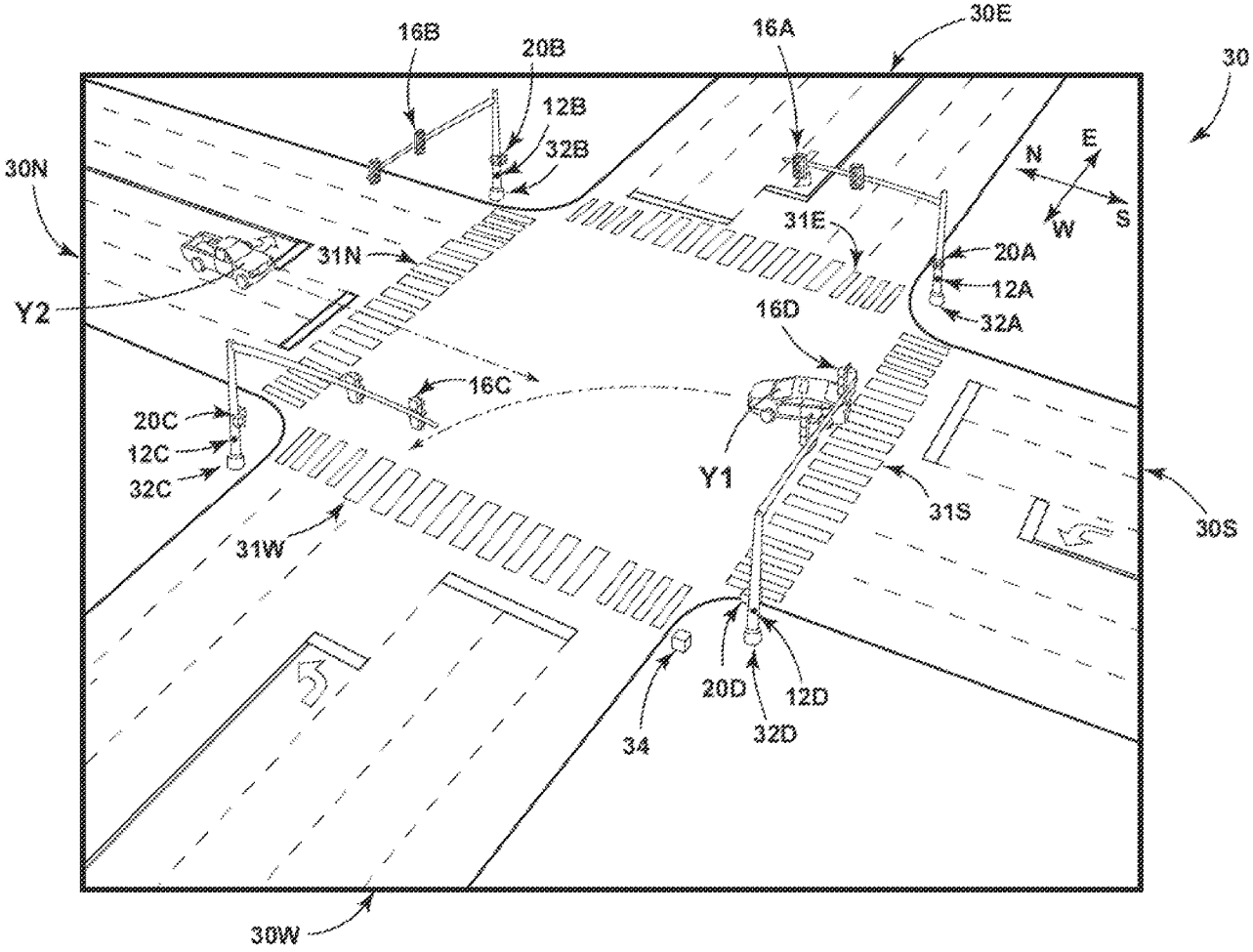
FIG. 5A illustrates operation of an intersection in accordance with the process of FIG. 5.

FIG. 5 illustrates one possible process 200 used by system 10 for detecting and avoiding a collision involving a left turn situation. The process 200 may be implemented in software, hardware, or a combination of the two. As illustrated in FIG. 5A, the process 200 involves two vehicles: Y1, moving North, and Y2, moving South, at traffic intersection 30. Traffic signal 16B is signaling a left turn arrow, and Y1 is travelling North to make a left turn to the West. Traffic signal 16D is signaling red for stop, and Y2 is travelling Southward on a trajectory straight through the intersection. In step S1, the central controller 24 receives: the locations, Y1($t$) and Y2($t$), and the velocities, Vy1($t$) and Vy2($t$), of the vehicles from the radar sensors 12A-D; the temperature, T, and the moisture content, rH, of the air proximate the intersection from the ambient conditions sensor; and the time remaining, t*, for the turn arrow from the traffic-lights-and-turn-signals controller 14. In step S2, the controller uses this data to determine the accelerations, ay1($t$) and ay2($t$), of the vehicles, and the coefficient of friction, μ, of the road surface. In step S3, the central controller 24 determines the trajectories of the vehicles and estimates the time to cross the intersection for Y1, tn, and Y2, ts. In step S4, the central controller 24 compares ts, tn, and t* to predict the likelihood of a collision. For example, if Y2 is stopped at the intersection and not moving, and Y1 is proceeding through the intersection making a left turn, but tn is greater than t*, the controller may predict that a collision is likely if the traffic signal 16D transitions from red to green and Y2 enters the intersection while Y1 is still turning. If the central controller 24 determines that a collision is likely, it will, in step S5, send a command to the traffic-lights-and-turn-signals controller 14 to delay the transition of the red signal to green in an attempt to prevent Y2 from entering the intersection, thereby potentially avoiding the collision, and begin the process again at step S1. If the central controller 24 determines that a collision is not likely, then it will begin the process again at step S1.

Figure 6:
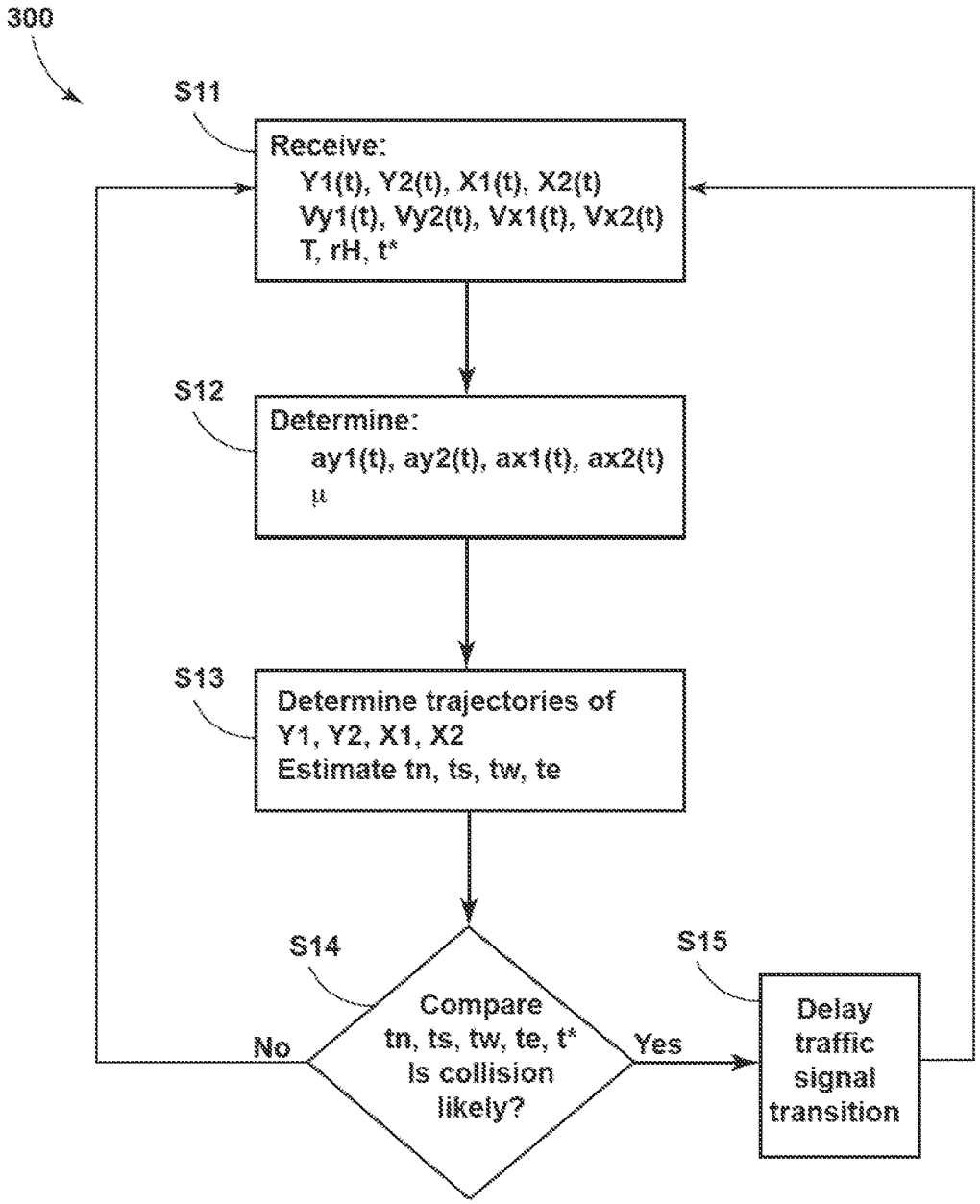
FIG. 6 illustrates one possible process for detecting the likelihood of a collision.
Figure 6A:
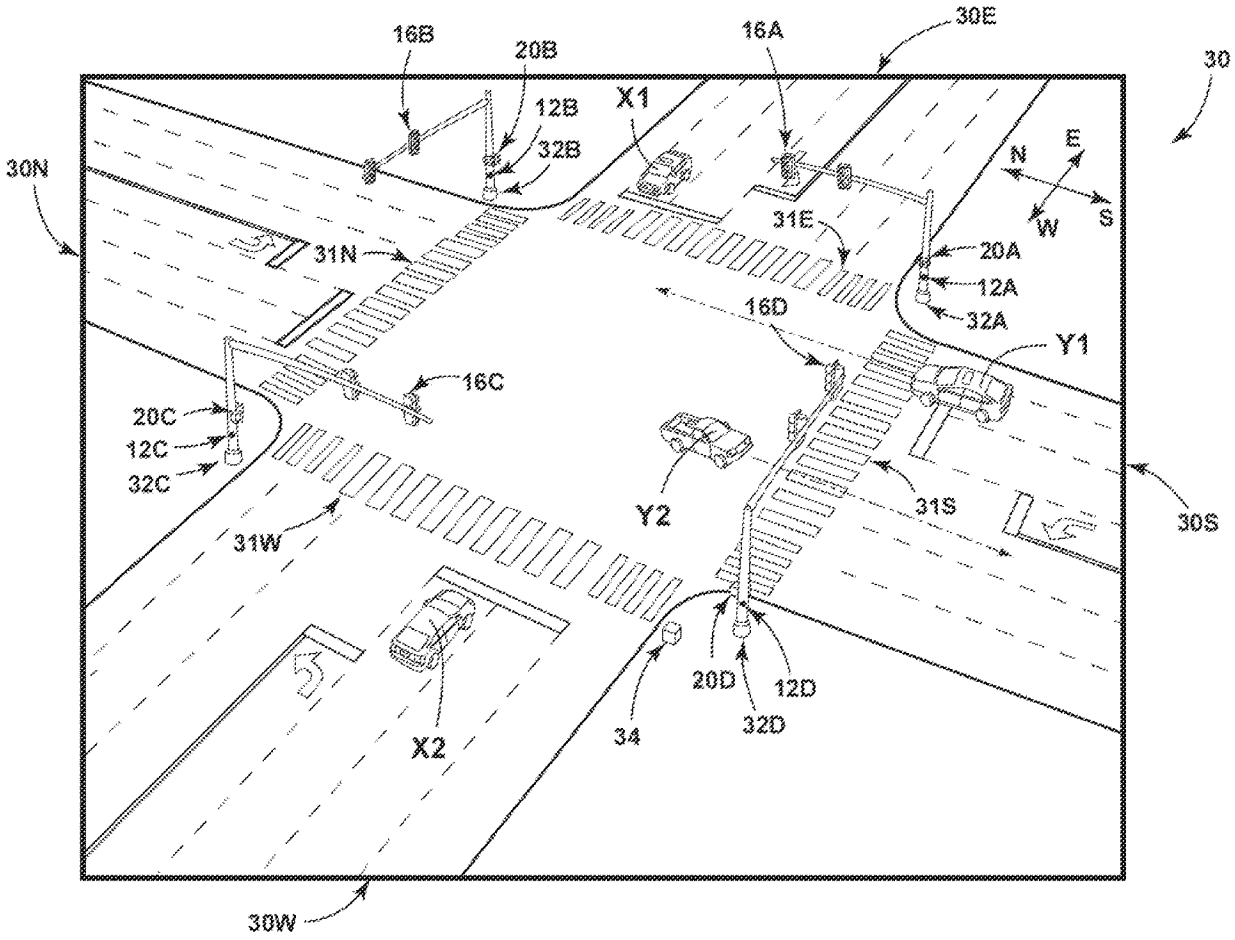
FIG. 6A illustrates operation of an intersection in accordance with the process of FIG. 6.

FIG. 6 illustrates one possible process 300 used by system 10 for detecting and avoiding a possible collision that does not involve turns. The process 300 may be implemented in software, hardware, or a combination of the two. As illustrated in FIG. 6A, this process involves four vehicles: X1, X2, Y1, and Y2, at traffic intersection 30. Traffic signals 16B and 16D are transitioning from green to amber to red, and traffic signals 16A and 16C are ready to transition from red to green. Vehicles X1 and X2 are stopped for the red traffic signals 16A and 16C. Vehicle X1 is facing West, and Vehicle X2 is facing East. Vehicle Y1 is entering the intersection travelling North, and vehicle Y2 is in the intersection travelling South, about to clear the intersection. In step S11, the central controller 24 receives: the locations, Y1($t$), Y2($t$), X1($t$), and X2($t$), and the velocities, Vy1($t$), Vy2($t$), Vx1($t$), and Vx2($t$) of the vehicles from the radar sensors 12A-D; the temperature, T, and the moisture content, rH, of the air proximate the intersection from the ambient conditions sensor; and the time remaining, t*, until the traffic signal transitions complete from the traffic-lights-and-turn-signals controller 14. In step S12, the central controller 24 uses this data to determine the accelerations, ay1($t$), ay2($t$), ax1($t$), and ax2($t$) of the vehicles, and the coefficient of friction, μ, of the road surface. In step S13, the central controller 24 determines the trajectories of the vehicles and estimates the time to cross the intersection for Y1, tn; Y2, ts; X1, tw; and X2, te. In step S14, the central controller 24 compares tn, ts, tw, te, and t* to predict the likelihood of a collision. For example, if tn is greater than t*, then it is possible that X1 and X2 will enter the intersection when traffic signals 16A and 16D transition from red to green, but before Y1 clears the intersection. In that case, the controller would predict a collision is likely. If the central controller 24 determines that a collision is likely, it will, in step S15, send a command to the traffic-lights-and-turn-signals controller 14 to delay the transition of the traffic signals 16A and 16D from red to green in an attempt to prevent X1 and X2 from entering the intersection, thereby potentially avoiding the collision, and begin the process again at step S11. If the central controller 24 determines that a collision is not likely, then it will begin the process again at step S11.

Thus, the invention provides, among other things, a system and method for collision avoidance in traffic crossings using a controller and radar sensors. Various features and advantages of the invention are set forth in the following claims.

What is claimed is:

1. A system for avoiding collisions in a traffic intersection, the traffic intersection having a plurality of sides, the system comprising:

one or more radar sensors, the one or more radar sensors positioned to detect objects approaching the traffic intersection from all of the sides;

a traffic-lights-and-turn-signals controller;

an ambient conditions sensor capable of sensing at least an ambient temperature value and a relative humidity value for the air proximate the traffic intersection; and a central controller, which is electrically connected to the one or more radar sensors, the traffic-lights-and-turn-signals controller, and the ambient conditions sensor, and is configured to receive data from the one or more radar sensors;

detect, based on the data from the one or more radar sensors, at least two objects in or approaching the traffic intersection, where each of the at least two objects is a vehicle or a vulnerable road user;

receive, for each of the at least two objects, a speed and a size;

determine, based on the speed and the size, whether each of the at least two objects is the vehicle or the vulnerable road user;

receive data from the ambient conditions sensor, and the traffic-lights-and-turn-signals controller;

determine, based on the data from the ambient conditions sensor and the speed and size of each of the at least two objects, a likelihood of a collision during a traffic signal transition; and issue a command to the traffic-lights-and-turn-signals controller to cause a delay in the traffic signal transition, while maintaining at least one predetermined traffic signal timing sequence.

2. The system of claim 1, wherein the traffic signal transition comprises the traffic signal for incoming traffic changing from green to amber to red, and the traffic signal for stopped traffic changing from red to green, and delaying the traffic signal transition includes delaying the changing of the traffic signal for stopped traffic from red to green.

3. The system of claim 1, wherein the traffic signal transition comprises a turn arrow for incoming traffic changing from green to amber to red, and the traffic signal for stopped traffic changing from red to green, and delaying the traffic signal transition includes delaying the changing of the traffic signal for stopped traffic from red to green.

4. A system for avoiding collisions in a traffic intersection, the traffic intersection having a plurality of sides and at least one pedestrian crosswalk, the system comprising:

one or more radar sensors, the one or more radar sensors positioned to detect objects approaching the traffic intersection from all of the sides, and to detect objects in the at least one pedestrian crosswalk;

a traffic-lights-and-turn-signals controller;

a pedestrian-signals controller;

an ambient conditions sensor capable of sensing at least an ambient temperature value and a relative humidity value for the air proximate the traffic intersection; and a central controller, which is electrically connected to the one or more radar sensors, the traffic-lights-and-turn-signals controller, the pedestrian-signals controller, and the ambient conditions sensor, and is configured to receive data from the one or more radar sensors;

detect, based on the data from the one or more radar sensors, at least two objects in or approaching the traffic intersection, where each of the at least two objects is a vehicle or a vulnerable road user;

receive, for each of the at least two objects, a speed and a size;

determine, based on the speed and the size, whether each of the at least two objects is the vehicle or the vulnerable road user;

receive data from the ambient conditions sensor, the traffic-lights-and-turn-signals controller, and the pedestrian-signals controller;

determine, based on the data from the ambient conditions sensor and the speed and size of each of the at least two objects, a likelihood of a collision during a traffic signal transition; and issue commands to the traffic-lights-and-turn-signals controller and the pedestrian-signals controller to cause a delay in the traffic signal transition, while maintaining at least one predetermined traffic signal timing sequence.

5. The system of claim 4, wherein the traffic signal transition comprises the traffic signal for incoming traffic changing from green to amber to red, and the traffic signal for stopped traffic changing from red to green; and delaying the traffic signal transition includes delaying the changing of the traffic signal for stopped traffic from red to green, and delaying a crosswalk signal changing from Don't Walk to Walk.

6. The system of claim 4, wherein the traffic signal transition comprises a turn arrow for incoming traffic changing from green to amber to red, and the traffic signal for stopped traffic changing from red to green; and delaying the traffic signal transition includes delaying the changing of the traffic signal for stopped traffic from red to green, and delaying a crosswalk signal changing from Don't Walk to Walk.

7. The system of claim 1 or 4, wherein the central controller is further configured to communicate the likelihood of the collision to an intelligent traffic system.

8. The system of claim 1 or 4, further comprising:

a watchdog mechanism, wherein the watchdog mechanism monitors the operation of the one or more radar sensors, and when a first radar sensor of the one or more radar sensors detects an object, and a second radar sensor of the one or more radar sensors does not detect the object, determines the existence of a malfunction, and a source of the malfunction; and a failsafe mechanism for instructing the central controller to avoid relying on the source of the malfunction, wherein the first radar sensor and the second radar sensor are positioned such that both should detect the object simultaneously, and the watchdog mechanism activates the failsafe mechanism when the existence of the malfunction is determined.

9. A method for operating traffic signals for collision avoidance, the method comprising:

detecting at least two objects in or approaching a traffic intersection, where each of the at least two objects is a vehicle or a vulnerable road user;

receiving, for each object of the at least two objects, a location of the object,
a direction of travel of the object,
a speed of the object, and
a size of the object;

receiving a temperature value and a relative humidity value for the air proximate the traffic intersection;

estimating a coefficient of friction of the traffic intersection;

determining whether each of the at least two objects is the vehicle or the vulnerable road user, based on the speed and the size of each object;

determining, for each of the at least two objects, a trajectory;

receiving a remaining time for a traffic signal transition;

determining a likelihood of a collision using the trajectories for each of the at least two objects, the coefficient of friction of the intersection, the temperature value, the relative humidity value, the speed and size of each of the at least two objects, and the remaining time for the traffic signal transition;

delaying the traffic signal transition to avoid the collision, while maintaining at least one predetermined traffic signal timing sequence.

* * * * *